US006381882B1

(12) United States Patent
Mizutani et al.

(10) Patent No.: US 6,381,882 B1
(45) Date of Patent: May 7, 2002

(54) WORK CONTROL SYSTEM FOR A TRENCHER TYPE EXCAVATOR FOR SOIL CEMENT WALL

(75) Inventors: Motohiko Mizutani; Tadao Nakayama, both of Akashi; Shozo Kajikawa, Toyonaka; Fujio Itoh, Tokyo, all of (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/468,909

(22) Filed: Dec. 22, 1999

(30) Foreign Application Priority Data

Dec. 24, 1998 (JP) ..... 10-367425

(51) Int. Cl.[7] ..... E02F 3/08

(52) U.S. Cl. ..... 37/462; 37/906; 37/352; 405/267

(58) Field of Search ..... 37/352, 353, 347, 37/348, 382, 189, 462, 465, 906; 172/2; 701/50; 405/267, 275, 269

(56) References Cited

U.S. PATENT DOCUMENTS 4,807,131 A * 2/1989 Clegg ..... 701/50
5,244,315 A 9/1993 Kitanaka et al.
5,257,471 A 11/1993 Kitanaka
5,349,765 A 9/1994 Kitanaka et al.
5,561,923 A 10/1996 Kitanaka
5,590,041 A * 12/1996 Cooper ..... 701/50
6,047,227 A * 4/2000 Henderson et al. ..... 701/50
6,070,673 A * 6/2000 Wendte ..... 172/2

FOREIGN PATENT DOCUMENTS

JP 8-165641 * 6/1996
JP 11-117349 * 4/1999
JP 11-200403 * 7/1999

* cited by examiner

*Primary Examiner*—Victor Batson
(74) *Attorney, Agent, or Firm*—Oblon, Spivak, McClelland, Maier & Neustadt, P.C.

(57) ABSTRACT

The present invention provides a work control system for a trencher type excavator for soil cement wall, wherein in controlling the work of forming a soil cement wall carried out in the procedure such that a cutter post provided on a trencher type excavator for soil cement wall and having a chain cutter wound endlessly is inserted into the object ground, the cutter post is rotated while discharging a ground filler out of a discharge opening provided in the cutter post, and the cutter post is moved in a lateral direction of the ground, execution width of the soil cement wall based on a fixed work load, and filling quantity of the ground filler at each position of the soil cement wall forming work are displayed on a two-dimensional coordinate in a lateral axis and a longitudinal axis, respectively. The quantities of ground hardening liquid discharged out of the ground filler discharge opening at the lower end of the cutter post can be instantly measured, and further, the results therefrom can be visually expressed according to the progressing position of work to effectively carry out execution control, and various execution controls such as discharge control of ground hardening liquid from plant can be carried out simply and positively even by a person short of experience.

11 Claims, 4 Drawing Sheets

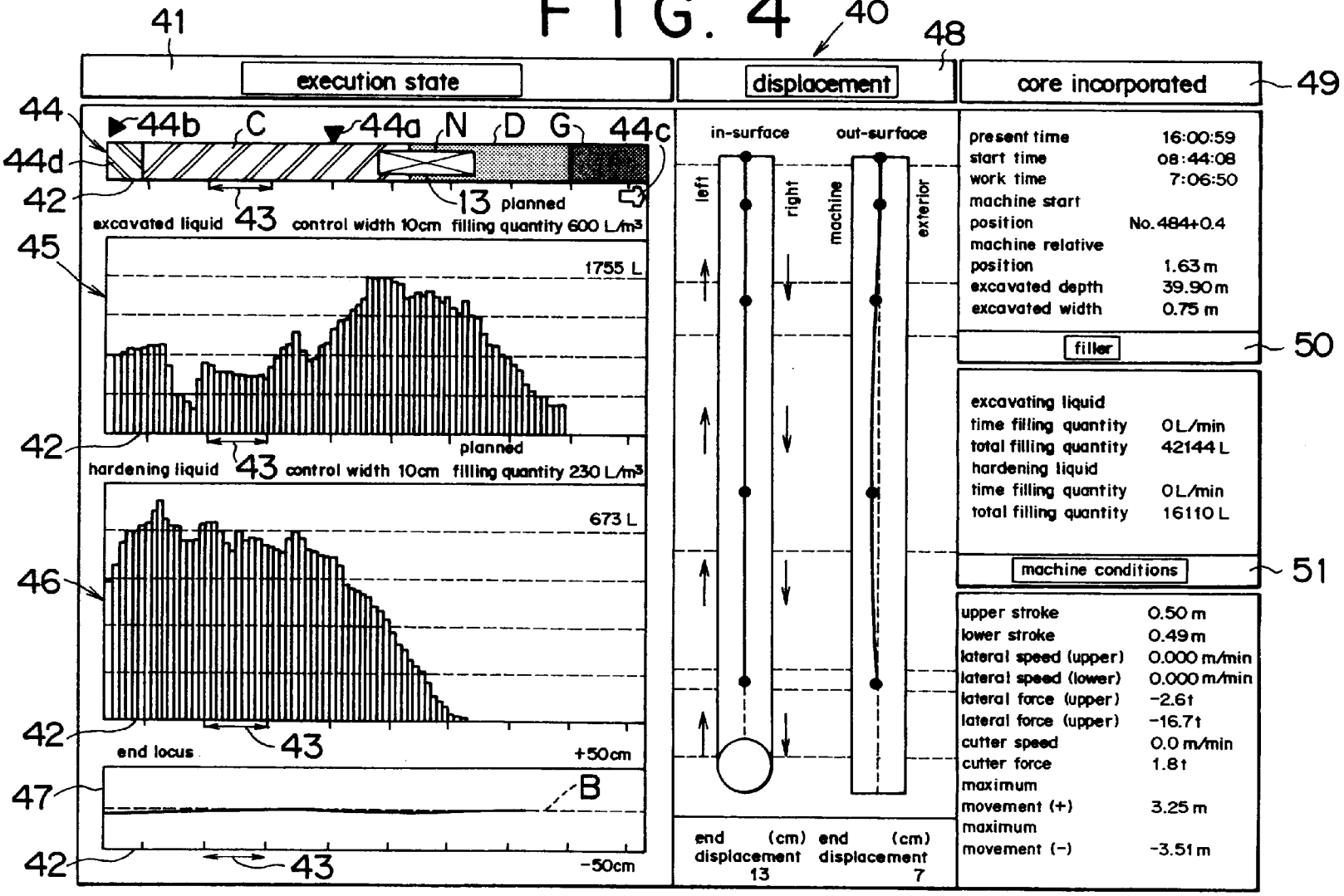
FIG. 4
40
41
42
43
44
44a
44b
44c
44d
45
46
47
48
49
50
51
execution state
displacement
core incorporated
present time 16:00:59
start time 08:44:08
work time 7:06:50
machine start position No.484+0.4
machine relative position 1.63 m
excavated depth 39.90 m
excavated width 0.75 m
filler
excavating liquid
time filling quantity 0 L/min
total filling quantity 42144 L
hardening liquid
time filling quantity 0 L/min
total filling quantity 16110 L
machine conditions
upper stroke 0.50 m
lower stroke 0.49 m
lateral speed (upper) 0.000 m/min
lateral speed (lower) 0.000 m/min
lateral force (upper) -2.6 t
lateral force (upper) -16.7 t
cutter speed 0.0 m/min
cutter force 1.8 t
maximum movement (+) 3.25 m
maximum movement (-) -3.51 m
out-surface
in-surface
exterior
machine
right
left
end displacement (cm) 13
end displacement (cm) 7
control width 10cm filling quantity 600 L/m³
excavated liquid
planned
1755 L
control width 10cm filling quantity 230 L/m³
hardening liquid
planned
673 L
end locus
+50cm
-50cm
B
C
D
G
N

WORK CONTROL SYSTEM FOR A TRENCHER TYPE EXCAVATOR FOR SOIL CEMENT WALL

BACKGROUND OF THE INVENTION

1. Field of the Invention

The present invention relates to a work control system for a trencher type excavator for soil cement wall.

2. Description of the Related Art

As a method developed in an attempt of obtaining high accuracy execution or the like which has higher cutoff performance and is excellent in advancing property and perpendicularity of execution, in connection with execution of soil cement underground continuous wall formed as a cutoff and retaining wall in execution of lower sections of construction structures, shield start longitudinal piles and so on, there has been proposed a method using a trencher type excavator for soil cement wall (hereinafter sometimes abbreviated as an excavator), which method is called a TRD method (method for a soil cement underground continuous wall) (See, for example, Japanese Patent Application Laid-Open Nos. 5-17946 and 5-280043 Publications, which are hereby incorporated by reference).

The aforesaid excavator used in this method mainly comprises a base machine capable of moving on the surface of the earth, and a cutter post around which is wound a chain saw type cutter provided with a plurality of cutting bits, supported on the base machine. This cutter presses the ground while rotating about the cutter post to dig a trench.

During the time just mentioned above, excavating muddy water is discharged out of a ground filler discharge opening provided in the lower end of the cutter post to assist excavation of trench, or ground hardening liquid is discharged out of the aforesaid discharge opening to mix and stir it with the excavated earth or the like to form a soil cement wall.

However, in the conventional TRD method, execution control such as control of discharge quantity of the ground hardening liquid is done depending on the experience of a well-experienced operator, and control thereof by an inexperienced person has been difficult.

SUMMARY OF THE INVENTION

It is an object of the present invention to provide a work control system for a trencher type excavator for soil cement wall which enables carrying out the discharge quantity control of a ground filler and the work control for a soil cement wall formed as a result therefrom, simply and positively by even an inexperienced operator.

According to the present invention, there is provided a work control system, which has, in controlling the work of forming a soil cement wall carried out in the procedure such that a cutter post provided on a trencher type excavator for soil cement wall and has a chain cutter wound endlessly is inserted into the object ground, the chain cutter is rotated while discharging a ground filler out of a discharge opening provided in the cutter post, and the cutter post is moved in a lateral direction of the ground, a display means for displaying at least execution width of the soil cement wall formed by the excavator, and filling quantity of the ground filler at each position of the soil cement wall forming work. For example, this is a display means for display on a two-dimensional coordinate with the execution width in a lateral axis and the filling quantity in a longitudinal axis.

Further, it is suitable that in the cutter post, the width dimensions of the side parallel to the wall surface of the soil cement wall is divided to set a plurality of control widths, and the ground filler quantities discharged out of the discharge opening at a suitable soil cement wall forming work position are assigned to the respective control widths.

On the other hand, the present invention comprises a display means, which displays at least any of an area having soil cement wall already installed, an area being formed with soil cement wall, an area of the ground for which work is not yet started, or the present position of the cutter post which, representing an execution condition display frame with the control width set by dividing the width dimensions of the side parallel to the wall surface of the soil cement wall of the cutter post and set being unit graduation, divide the frame, within the frame. For example, the execution condition display frame is a web-like display frame.

Moreover, it is suitable that data of the actual discharge quantity of the ground filler obtained by the work control system of the excavator are transmitted to the plant for supplying the ground filler for discharge quantity control of the ground filler.

BRIEF DESCRIPTION OF THE DRAWINGS

FIG. 4 is an explanatory view of, in the work control system for the excavator according to the present invention, a work control screen in which filling quantities of ground filler at respective soil cement wall forming work positions.

DESCRIPTION OF THE PREFERRED EMBODIMENTS

The preferred embodiments of the present invention will now be described with reference to the accompanying drawings.

Figure 1:
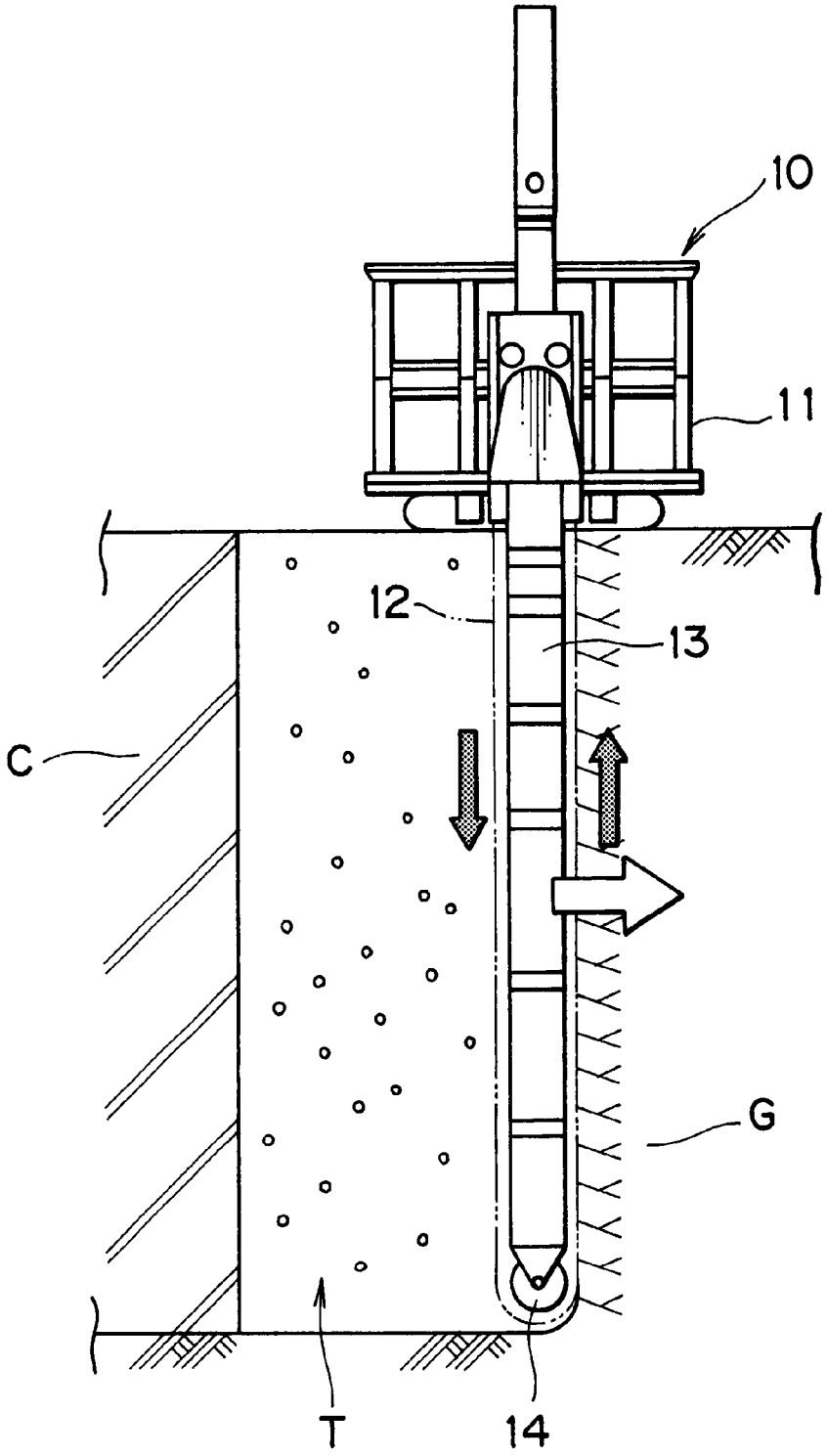
FIG. 1 is [an explanatory] a schematic view of the TRD method.

FIG. 1 is an explanatory view showing a conception of the TRD method. A trencher type excavator 10 for soil cement wall used in this method mainly comprises a base machine 11 capable of moving on the surface of the earth, and a cutter post 13 around which is wound a chain saw type cutter provided with a plurality of cutting bits, the cutter 12 presses the ground G while rotating about the cutter post 13 to dig a trench T.

During the time just mentioned above, excavating muddy water is discharged out of a ground filler discharge opening 14 provided in the lower end of the cutter post 13 to assist excavation of trench T under suitable pressure, or ground hardening liquid is discharged out of the aforesaid discharge opening to mix and stir it with the excavated earth or the like to form a soil cement wall C.

With respect to the execution order of the excavation of trench T and the formation of soil cement wall, there are suitably selected, depending on the execution state, a so-called "1 pass" execution for continuously executing the both in combination, "2 pass" execution for carrying out, after completion of the excavation of trench T, formation of soil cement wall along the trench T, or "3 pass" execution for moving again, after completion of the excavation of trench T, the cutter post 13 to a trench excavating start position and forming a soil cement wall along the trench T.

Normally, the executions as described above are carried out over several days. In such a case as described, the end of the soil cement wall C formed till the previous day is suitably cut to secure continuity with a soil cement wall to be formed newly on the day.

Figure 2:
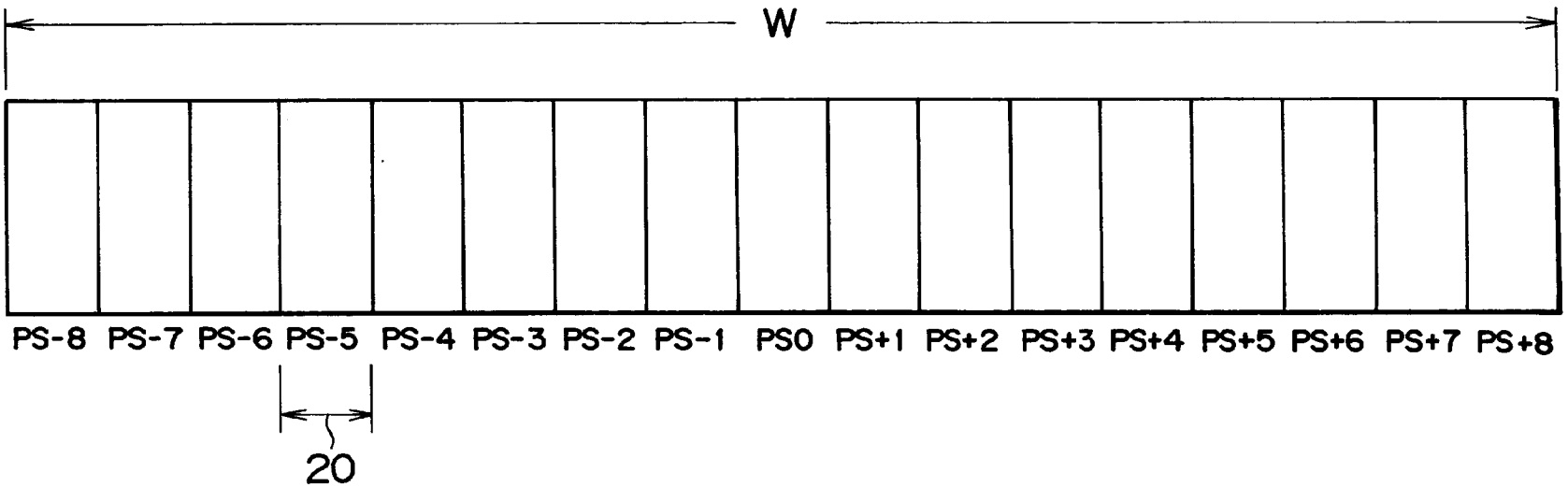
FIG. 2 is an explanatory view showing, with respect to width dimensions of a cutter post provided on a trencher type excavator for soil cement wall used for the TRD method, a state of being divided into a plurality of set control widths.

FIG. 2 shows a state that width dimensions W of the cutter post 13 provided on the excavator 10 used for the TRD method are divided into a plurality of set control widths 20.

The fundamental ways of thinking in the control of the TRD method according to the present invention are that first, width dimensions W (for example, 1700 mm in the present invention) of the side parallel to the soil cement wall surface G of the cutter post 13 are divided into a plurality of set control widths 20 (for example, 100 mm) (accordingly, 17 divisions in the present invention) as shown.

Accordingly, there is supposed a state similar to that in which at a suitable working position for forming soil cement wall, the ground filler quantity discharged out of, for example, a nozzle-like discharging opening 14 provided at the lower end of the cutter post 13 is, for example, uniformly assigned to the respective set control widths 20, and uniformly discharged out of substantially the whole surface at the lower end of the cutter post 13.

The ground filler quantity is not only uniformly assigned to the respective set control widths 20, and uniformly discharged out of substantially the whole surface at the lower end of the cutter post 13 but also the ground filler quantity assigned according to positions of the set control widths may be changed to carry out setting of applying a weight to the assigning distribution.

Figure 3:
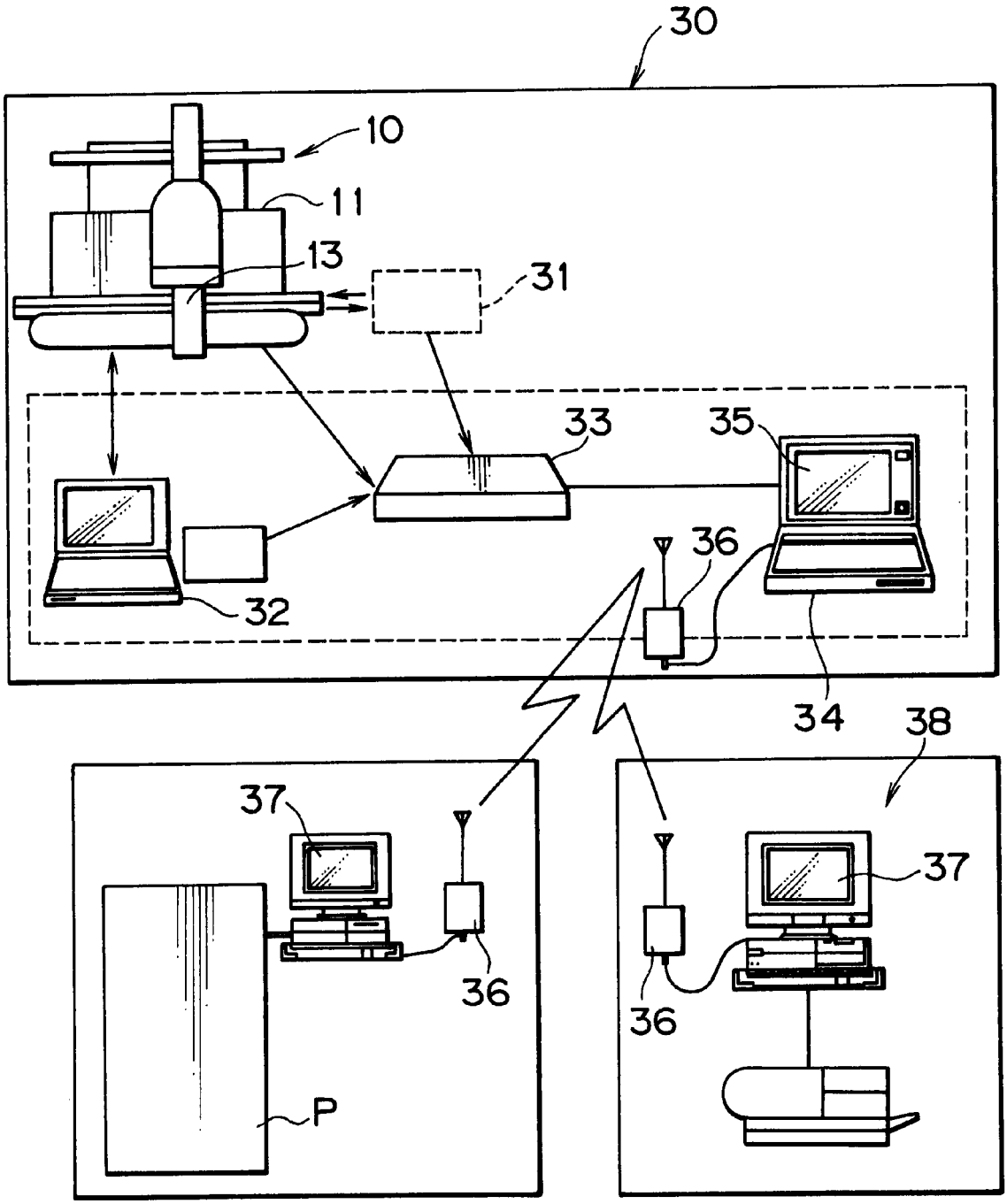
FIG. 3 is a conceptual view showing the work control system for the excavator according to the present invention.

FIG. 3 is a conceptual view showing the work control system 30 for the excavator 10 according to the present invention.

The present system is mainly composed of an excavator 10, a light-wave distance measuring meter 31 provided at one end on an execution schedule line on which soil cement wall C is formed to measure distance relative to the excavator and specify a position of excavator on the execution schedule line, a portable computer 32 for obtaining a signal of an inclination sensor or the like mounted on the excavator 10 to analyze an angle of inclination of the excavator 10, a data converter 33 for unifying data such as an operating state of various parts of the excavator 10, the position of excavator, and the angle of inclination for applying signal process, a unifying and processing computer 34 for carrying out various analyses and graphing process on the basis of the unified data transmitted form the data converter 33, and a work control display monitor 35 for displaying the processed result.

The aforementioned system constitution may be modified to be expanded such that for example, the unifying and processing computer 34 and a ground filler plant P are connected by a communication means such as wireless 36 so that a plant operator operates the plant while checking the processed results by a monitor 37, or the unifying and processing computer 34 and the ground filler plant P are connected through an automatic control unit so that the discharge quantity of the ground filler is automatically adjusted and controlled.

Alternatively, the unifying and processing computer 34 and a site office 38 for controlling the whole execution are connected to carry out synthetic judgement so that efficient execution may be carried out.

FIG. 4 shows a work control screen 40 displayed by the work control display monitor 35. In the work control screen 40, a substantially left half of the screen is an execution state display area 41, on the upper end of which is represented a web-like execution state display frame 44, with soil cement wall execution widths 42 based on a fixed work load (for example, a work load a day in the present embodiment) being represented on the lateral axis, with set control widths 20 (every 100 mm) being used as unit graduations 43 on the lateral axis, the display frame 44 being internally divided preferably by colors into an area C having soil cement wall already installed, an area D being formed with soil cement wall, and an area G for which work is not yet started, the present position N of the cutter post being indicated as well within the frame.

Further, below the execution state display frame 44 are shown, with respect to excavating liquid which is a ground filler and ground hardening liquid, filling quantity display graphs 45 and 46 indicating the filling quantities of respective liquids at positions of excavator on a schedule line of execution for soil cement wall.

The execution state display frame 44 and the filling quantity display graphs 45 and 46 according to the present embodiment represent a state that the cutter post 13 is positioned at the end of the area C having soil cement wall already installed till the previous day, and the discharge of the ground hardening liquid is rarely carried out in prior areas (the right-hand of the frame is an execution schedule direction) but only the excavation of trench T accompanied by discharge of the executing liquid is carried out.

Note that the downward triangular mark 44*a* at the upper part of frame indicates a work start position of the cutter post in the pertinent day, the rightward triangular mark 44*b* at the upper part on the left end of the frame indicates a measuring direction of the light-wave measuring meter, and the white arrow 44*c* at the lower part on the right end of the frame indicates an excavation progressing direction.

A cutting tolerance 44*d* may be displayed on the left end portion in the frame to provide connecting integrity of the end of soil cement wall formed on the previous day and soil cement wall formed on the pertinent day.

Below the graphs 45 and 46 is indicated an end locus 47 of the cutter post 13 with an execution schedule line B as a base line so that the execution made with what eccentricity from that expected at the outset is clearly determined.

In addition, a displacement 48 at the extreme end of the cutter post 13 in the vertical direction is also indicated at substantially one half on the left hand of the right half portion of the work control screen so that the perpendicularity of the soil cement wall C executed is instantly assured.

In addition to those indicated above, a core incorporated state area 49 showing the time and position incorporated or the depth, with respect to the core such as H-steel incorporated into the soil cement wall C, a filler quantity display area 50 showing the total filling quantity of ground filler, and a machine-condition display area 51 showing an execution state such as the moving length, speed or the like of the excavator 10 may be indicated as well.

While in the present embodiment, the width dimension of the cutter post was 1700 mm, the set control width was 100 mm, and the 17 divisions in all were illustrated, it is to be noted that these are not restricted thereto but may be suitably changed according to the width dimensions of the cutter post selectively used, and the control viscosity obtained or the like.

Further, the work control screen is not limited to the layout in the aforementioned embodiment, and the graphs and the display frame may be re-arranged and changed adjusting to the using object and the execution state or the like.

Furthermore, while in the present embodiment, the execution state display frame has been internally divided into an area having soil cement wall already installed, an area being formed with soil cement wall, and an area for which work is not yet started, the present position of the cutter post being indicated as well within the frame, it is to be noted that various combined display patterns, for example, such that the frame is internally divided merely into an area being formed with soil cement wall, and an area for which work is not yet started, may be applied.

We claim:

1. A work control system, comprising:

an excavator adapted for forming a soil cement wall; and a display means for displaying an execution width of the soil cement wall, and filling quantities of a ground filler at working positions of forming the soil cement wall.

2. The work control system according to claim 1, wherein the display means comprises a display made of said execution width in a lateral axis and said filling quantities in a longitudinal axis on a two-dimensional coordinate.

3. The work control system according to claim 1, further comprising:

a cutter post provided with said excavator and having an endless chain cutter;

a control width setting means for dividing width dimensions of a side surface of the cutter post parallel to a surface of said soil cement wall so as to set a plurality of control widths; and an assigning means for assigning quantities of the ground filler discharged out of a discharge opening provided in said cutter post at a suitable forming working position of said soil cement wall, to said control widths respectively.

4. A work control system comprising:

an excavator adapted for forming a soil cement wall;

a cutter post provided with said excavator and having an endless chain cutter; and a display means for displaying an execution state display frame, with an execution width of the soil cement wall based on a fixed work load being an overall width, said display means having width unit graduations corresponding to width dimensions of a side surface of the cutter post parallel to a surface of said soil cement wall, said display means displaying at least any of an area having the soil cement wall already installed, an area being formed with said soil cement wall, an area for which work is not yet started, and the present position of said cutter post so as to divide the display frame within said display frame.

5. The work control system according to claim 1, further comprising:

a discharge quantity control means for transmitting data of discharge quantities of a ground filler discharged out of a discharge opening provided on the excavator and having a chain cutter wound endlessly to a plant for supplying the ground filler to control the discharge quantities of the ground filler.

6. The work control system according to claim 2, further comprising:

a discharge quantity control means for transmitting data of discharge quantities of a ground filler discharged out of a discharge opening provided on the excavator and having a chain cutter wound endlessly to a plant for supplying the ground filler to control the discharge quantities of the ground filler.

7. The work control system according to claim 3, further comprising:

a discharge quantity control means for transmitting data of discharge quantities of a ground filler discharged out of a discharge opening provided on the excavator and having a chain cutter wound endlessly to a plant for supplying the ground filler to control the discharge quantities of the ground filler.

8. The work control system according to claim 4, further comprising:

a discharge quantity control means for transmitting data of discharge quantities of a ground filler discharged out of a discharge opening provided on the excavator and having a chain cutter wound endlessly to a plant for supplying the ground filler to control the discharge quantities of the ground filler.

9. A work control system comprising:

an excavator adapted for forming a soil cement wall;

a cutter post provided with said excavator and having an endless chain cutter and a discharge opening for a ground filler; and a display adapted to display at least one of an execution width of the soil cement wall and a filling quantity of the ground filler at each position of the soil cement wall in a two-dimensional coordinate system having a lateral axis and a longitudinal axis, respectively.

10. A work control system comprising:

an excavator adapted for forming a soil cement wall;

a cutter post provided with said excavator and having an endless chain cutter and a discharge opening for a ground filler; and a display adapted to display at least one of an area having the soil cement wall already installed, an area to be formed with the soil cement wall, an area of the ground for which work is not yet started, and the present position of the cutter post, said display including a web-like execution display frame having width unit gradiations corresponding to width dimensions of a side of the cutter post parallel to the wall surface of the soil cement wall.

11. A trencher type excavator for soil cement wall, comprising the work control system according to claim 1.

* * * * *